US007258836B2

(12) United States Patent
Hill et al.

(10) Patent No.: US 7,258,836 B2
(45) Date of Patent: Aug. 21, 2007

(54) FREEZE RESISTANT BUOY SYSTEM

(75) Inventors: David E. Hill, Knoxville, TN (US); Miguel Rodriguez, Jr., Oak Ridge, TN (US); Elias Greenbaum, Knoxville, TN (US); James W. Klett, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 746 days.

(21) Appl. No.: 10/689,261

(22) Filed: Oct. 20, 2003

(65) Prior Publication Data

US 2005/0084418 A1 Apr. 21, 2005

(51) Int. Cl.
*G01N 21/00* (2006.01)

(52) U.S. Cl. ..... 422/50; 422/68.1; 422/82.05; 114/326; 114/328; 116/107; 116/108; 441/6; 441/11; 441/32

(58) Field of Classification Search ..... 422/50, 422/58, 68.1, 82.05, 102; 116/107, 108, 116/109; 114/326, 328, 329; 441/6, 11, 441/12, 13, 32, 33
See application file for complete search history.

(56) References Cited

U.S. PATENT DOCUMENTS

| | | | | |
|---|---|---|---|---|
| 3,170,299 | A | 2/1965 | Clarke | |
| 3,376,588 | A * | 4/1968 | Berteaux et al. | 441/29 |
| 3,506,841 | A * | 4/1970 | Majkrzak | 290/2 |
| 3,719,936 | A * | 3/1973 | Daniels et al. | 441/1 |
| 4,089,209 | A | 5/1978 | Grana et al. | |
| 4,300,855 | A | 11/1981 | Watson | |
| 4,448,068 | A | 5/1984 | Sutherland et al. | |
| 4,500,641 | A | 2/1985 | van den Engh et al. | |
| 4,549,427 | A | 10/1985 | Kolesar, Jr. | |
| H454 | H | 4/1988 | Sickenberger et al. | |
| 4,752,226 | A | 6/1988 | Akers et al. | |
| 4,768,390 | A | 9/1988 | Baker et al. | |
| 4,906,440 | A | 3/1990 | Kolesar, Jr. | |
| 4,942,303 | A | 7/1990 | Kolber et al. | |
| 5,014,225 | A | 5/1991 | Vidaver et al. | |
| 5,218,366 | A * | 6/1993 | Cardamone et al. | 342/385 |
| 5,283,767 | A * | 2/1994 | McCoy | 367/4 |
| H1344 | H | 8/1994 | Baldauf et al. | |
| 5,481,904 | A * | 1/1996 | Fleck et al. | 73/61.51 |
| 5,532,679 | A | 7/1996 | Baxter, Jr. | |
| 5,654,692 | A | 8/1997 | Baxter, Jr. et al. | |

(Continued)

FOREIGN PATENT DOCUMENTS

| | | |
|---|---|---|
| CA | 2265304 | 3/1999 |

(Continued)

OTHER PUBLICATIONS

G.H. Krause, et al "Chlorophyll Fluorescence & Photosynthesis: The Basics," Annu. Rev. Plant Physiol. Plant Mol. Biol (1991) V. 42, p. 313-49.

(Continued)

*Primary Examiner*—Lyle A. Alexander
*Assistant Examiner*—Dwayne K Handy
(74) *Attorney, Agent, or Firm*—Joseph A. Marasco; Edna I. Gergel

(57) ABSTRACT

A freeze resistant buoy system includes a tail-tube buoy having a thermally insulated section disposed predominantly above a waterline, and a thermo-siphon disposed predominantly below the waterline.

11 Claims, 2 Drawing Sheets

U.S. PATENT DOCUMENTS

| | | | | |
|---|---|---|---|---|
| 5,794,126 | A * | 8/1998 | Tsutsumi et al. | 455/40 |
| 5,866,430 | A | 2/1999 | Grow | |
| 5,869,756 | A * | 2/1999 | Doherty et al. | 73/170.29 |
| 5,922,183 | A | 7/1999 | Rauh | |
| 5,965,882 | A | 10/1999 | Megerle et al. | |
| 6,083,740 | A | 7/2000 | Kodo et al. | |
| 6,119,630 | A | 9/2000 | Lobsiger et al. | |
| 6,119,976 | A | 9/2000 | Rogers | |
| 6,121,053 | A | 9/2000 | Kolber et al. | |
| 6,187,530 | B1 * | 2/2001 | Scholin et al. | 435/4 |
| 6,197,256 | B1 * | 3/2001 | Siepmann | 422/79 |
| 6,316,268 | B1 | 11/2001 | Yang et al. | |
| 6,402,031 | B1 | 6/2002 | Hall | |
| 6,569,384 | B2 | 5/2003 | Greenbaum et al. | |
| 6,787,106 | B2 * | 9/2004 | Keeping et al. | 422/50 |

FOREIGN PATENT DOCUMENTS

| | | | |
|---|---|---|---|
| DE | 41 40 414 | A1 | 6/1993 |
| DE | 19857792 | A1 | 7/2000 |
| EP | 0811842 | A1 | 12/1997 |
| WO | WO99/32876 | | 7/1999 |

OTHER PUBLICATIONS

G.H. Krause, et al "Photoinduced Quenching of Chlorophyll Fluorescence in Intact Chloroplasts & Algae," Biochimica et Biophysica Acta. V. 679, p. 116-124 (1982).
U. Schreiber et al "Chlorophyll Fluorescence as a Nonintrusive Indicator for Rapid Assessment of In Vivo Photosynthesis," Ecological Studies, 100, p. 49-70 (1994).
Bernard Genty et al "The Relationship Between the Quantum Yield of Photosynthetic Electron Transport & Quenching of Chlorophyll Fluorescence," Biochimica et Biophysics Acta,990, p. 87-92 (1989).
O. Van Kooten et al "The Use of Chlorophyll Fluorescence Nomenclature in Plant Stress Physiology," Photosynthesis Research, 15, p. 147-150 (1990).
G.E. Edwards et al "Can C02 Assimilation in Maize Leaves be Predicted Accurately from Chlorophyll Fluorescence Analysis," Photosynthesis Res., 37, p. 89-102 (1993).
G.G.R. Seaton et al "Chlorophyll Fluorescence as a Measure of Photosynthetic Carbon Assimilation," Proc. R. Soc. London Ser. B, 242, p. 17-108 (1995).
Martine Naessens et al "Fiber Optic Biosensor Using Chlorella Vulgaris for Determination of Toxic Compounds," Ecotoxicology and Env. Safety, 46, p. 181-185 (2000).
Heinz Walz, "Internet Web Site http://www.walz.com eg, http://www.walz.com/xepam.htm & http://www.walz.com/ pamzta.htm".
G. Dubelaar et al "Design & First Results of CytoBuoy: A Wireless Flow Cytometer for In Situ Analysis of Marine & Fresh Waters," Cytometer 37, p. 247-254 (1999).
R.K. Gelda et al "Estimating Oxygen Exchange Across the Air-Water Interface of a Hypereutrophic Lake," Hydrobiologia, 487, p. 243-254 (2002).
M. Rodriguez, Jr. et al "Biosensors for Rapid Monitoring of Primary-Source Drinking Water Using Naturally Occurring Photosynthesis," Biosensors & Bioelectronics 17, p. 843-849 (2002).
A. Pinto et al "Chlorophyll—A Determination via Continuous Measurement of Plankton Fluorescence: Methodology Development" Wat. Res. vol. 35, No. 16, p. 3977-3981 (2001).
C.A. Sanders et al "Stand-off Tissue-Based Biosensors for the Detection of Chemical Warfare Agents using Photosynthetic Fluorescence Induction," Biosensors & Bioelectronics 16 p. 439-446 (2001).
K. Wild-Allen et al "Observations of Diffuse Upwelling Irradiance & chlorophyll in Case I Waters Near the Canary Islands (Spain)" Optics & Laser Technology, V29, No. 1 p. 3-8 (1997).
T. Moore et al "Real-Time River Level Monitoring Using GPS Heighting," GPS Solutions, V.4, No. 2, p. 63-67 (2000).
D. Lapota et al "Development of an Autonomous Bioluminescence Buoy (BioBuoy) for Long-Term Ocean Measurements," SPAWAR Systems Center.
U.A. Korde, "A Note on the Hydrodynamic of a Tail Tube Buoy," Ocean Engineering 27, p. 1473-1484 (2000).
M. Kishino et al "Verification Plan of Ocean Color & Temperature Scanner Atmospheric Correction c Phytoplankton Pigment by Moored Optical Buoy System" Jl. of Geo. Res., V102,D14, p. 17,197-17, 207 (1997).
Drinking Water Standards and Health Advisories, Office of Water U. S. Environmental Protection Agency, Washington D.C. (2000).
J.W. Klett et al, "Flexible Towpreg for the Fabrication of High Thermal Conductivity Carbon/Carbon Composites," Carbon, V.33, No. 10, p. 1485-1503 (1995).
Guidelines for Chemical Warfare Agents in Military Field Drinking Water, National Academy Press, Washington, D.C. (1995).

* cited by examiner

FREEZE RESISTANT BUOY SYSTEM

The United States Government has rights in this invention pursuant to contract no. DE-AC05-00OR22725 between the United States Department of Energy and UT-Battelle, LLC.

CROSS-REFERENCE TO RELATED APPLICATIONS

Specifically referenced is commonly assigned U.S. Patent Application Ser. No. 10/689,316 filed on even date herewith, entitled "Enhanced Monitor System for Water Protection", the entire disclosure of which is incorporated herein by reference.

FIELD OF THE INVENTION

The present invention relates to freeze resistant buoy systems, and more particularly to freeze resistant buoy systems that draw heat from deeper water to prevent freezing of the buoy systems.

BACKGROUND OF THE INVENTION

Currently available buoy systems may be susceptible to freezing, disabling the activity of systems contained therein. For example, recent terrorist attacks in the United States have increased the awareness of the need for ways to protect drinking water supplies. Source waters for civilian populations and military facilities are vulnerable to such attacks. There is therefore a need for improved real-time water quality sensor systems that quickly and accurately detect toxic materials in a water source and transmit an indicative signal. In climates where water supplies freeze over during cold seasons, there is a need to protect such systems, and other buoy-mounted systems, from freezing.

Specifically referenced is commonly assigned U.S. Pat. No. 6,569,384 issued on May 27, 2003 to Greenbaum, et al. entitled "Tissue-Based Water Quality Biosensors for Detecting Chemical Warfare Agents", the entire disclosure of which is incorporated herein by reference.

Specifically referenced is U.S. Pat. No. 3,170,299 issued on Feb. 23, 1965 to Clarke, entitled "Means for Prevention of Ice Damage to Boats, Piers, and the Like", the entire disclosure of which is incorporated herein by reference.

OBJECTS OF THE INVENTION

Accordingly, objectives of the present invention include provision of buoy systems that are resistant to freezing, buoy systems that draw heat from deeper water to prevent freezing of the buoy systems, and means for protecting water supplies, especially primary-source drinking water, in cold climates. Further and other objects of the present invention will become apparent from the description contained herein.

SUMMARY OF THE INVENTION

In accordance with one aspect of the present invention, the foregoing and other objects are achieved by a freeze resistant buoy system which includes a tail-tube buoy having a thermally insulated section disposed predominantly above a waterline, and a thermo-siphon disposed predominantly below the waterline.

In accordance with another aspect of the present invention, a freeze resistant buoy system includes a tail-tube buoy having a thermally insulated section disposed predominantly above a waterline, a thermally conducting section disposed predominantly below the waterline, and a system housed within the buoy system for collecting and analyzing samples.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
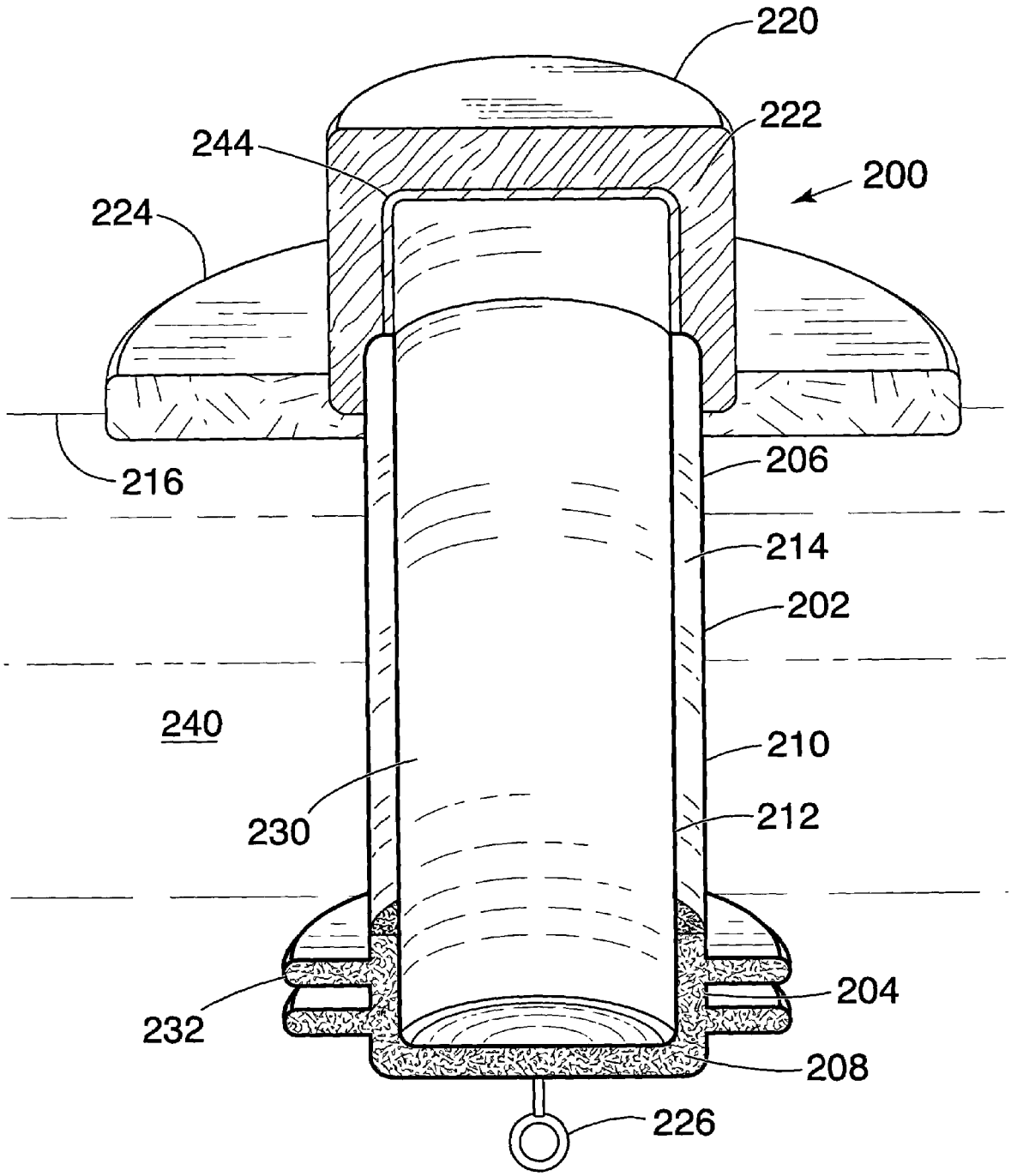
FIG. 1 is a cutaway view of an embodiment of the present invention that employs a thermo-siphon.

Referring to FIG. 1, the present invention is a tail-tube buoy system 200 that is adapted for deployment in colder climates. There are two essential parts to the buoy system 200, an upper section 220, which is disposed predominantly above the water line 216, and a lower section 202, which is disposed predominantly below the waterline 216. An anchoring ring 226 can be attached, for example to the bottom of the buoy 200. A buoyant stabilizing wing or collar 224 can be attached, for example, at the waterline 216.

The upper section 220 is comprised of a thermally insulating material 222, and, optionally, an inner liner 244 to provide structural integrity. The thermally insulating material 222 is preferably comprised of a suitable, commercially available insulation. Suggested examples are: blown foam; polystyrene foam; fiberglass; carbonaceous insulations such as Fiberform™ available from Fiber Materials, Inc., Selkirkshire, Scotland, UK; and carbon foam such as that available from ERG Materials and Aerospace Corporation, Oakland, Calif., Ultramet, Pacoima, Calif. and Touchstone Research Labs, Ltd., Triadelphia, W. Va. The thermally insulating material 222 protects the interior 230 of the buoy 200 from overheating in warm seasons, and from freezing in cold seasons. A conventional coating, layer, panel, or other type of shield may also be used therewith to shield the upper section 220 from direct sunlight, precipitation, and/or other environmental hazards.

The lower section 202 of the buoy 200 is thermally conductive. The thermally conductive lower section 202 is preferably inserted up inside the insulated upper section 220 in order to heat and/or cool the interior 230 above the waterline 216. Moreover, the thermally conductive lower section 202 can be made vertically contiguous in order to promote optimal heat transfer characteristics.

In one embodiment of the present invention, as shown in FIG. 1, the lower section 202 further comprises a thermo-siphon for efficiently transferring sensible heat from the bottom 204 to the water line region 206. The thermo-siphon 202 comprises an outer shell 210, and inner shell 212, with a hollow space 214 therebetween—similar in construction to a Dewar flask. A highly thermally conductive porous heat-exchange material, such as graphite foam described in U.S. Pat. No. 6,033,506, for example, 208 can be bonded into the bottom 204. The hollow space 214 is evacuated and partially backfilled with a heat transfer fluid such as water, fluorinert™ (available from Hampton Research, 34 Journey, Aliso Viejo, Calif. 92656-3317), acetone, or alcohol, for example.

The thermo-siphon 202 operates as follows: Sensible heat from deeper water 240 warms the bottom 204, and the porous material 208. The heat transfers to the heat transfer fluid which evaporates and rises to the waterline region 206. The heat transfer fluid condenses on the coldest part of the thermo-siphon 202, transferring the heat to the waterline region 206. The latent heat of condensation is usually sufficient to keep ice from forming, thus keeping the buoy free. The condensate then drains down to the bottom 204 for recycle and further evaporation. Hence, a totally passive vapor chamber rapidly transfers sensible heat from deeper water to the waterline region 206 of the buoy. The fluid transfer rate will change to accommodate the changes in heat duty due to environmental changes. Hence, during colder weather, more vapor will be generated, and during warmer weather, virtually no vapor will be generated. Selection of heat transfer fluid can be made with considerations of estimated service location, duty cycle, heat duty of the system, environmental conditions, and other factors.

The thermo-siphon 202 can be extended below the bottom of the buoy, or the buoy itself can be elongated in order to reach deeper, warmer water 240. Moreover, the thermo-siphon 202 may be enhanced by increasing the surface area of internally and/or externally thereof by any known means, such as, for example, flutes, fins, perforations, folds, etc. Fins 232 are shown at the bottom 204 in FIG. 1 as an example.

The Buoy can house a variety of mechanical, chemical, biological, electrical, electronic, sonic, optical, and/or other systems for collecting and analyzing samples of air, water, electromagnetic energy, other types of energy, and other materials.

Figure 2:
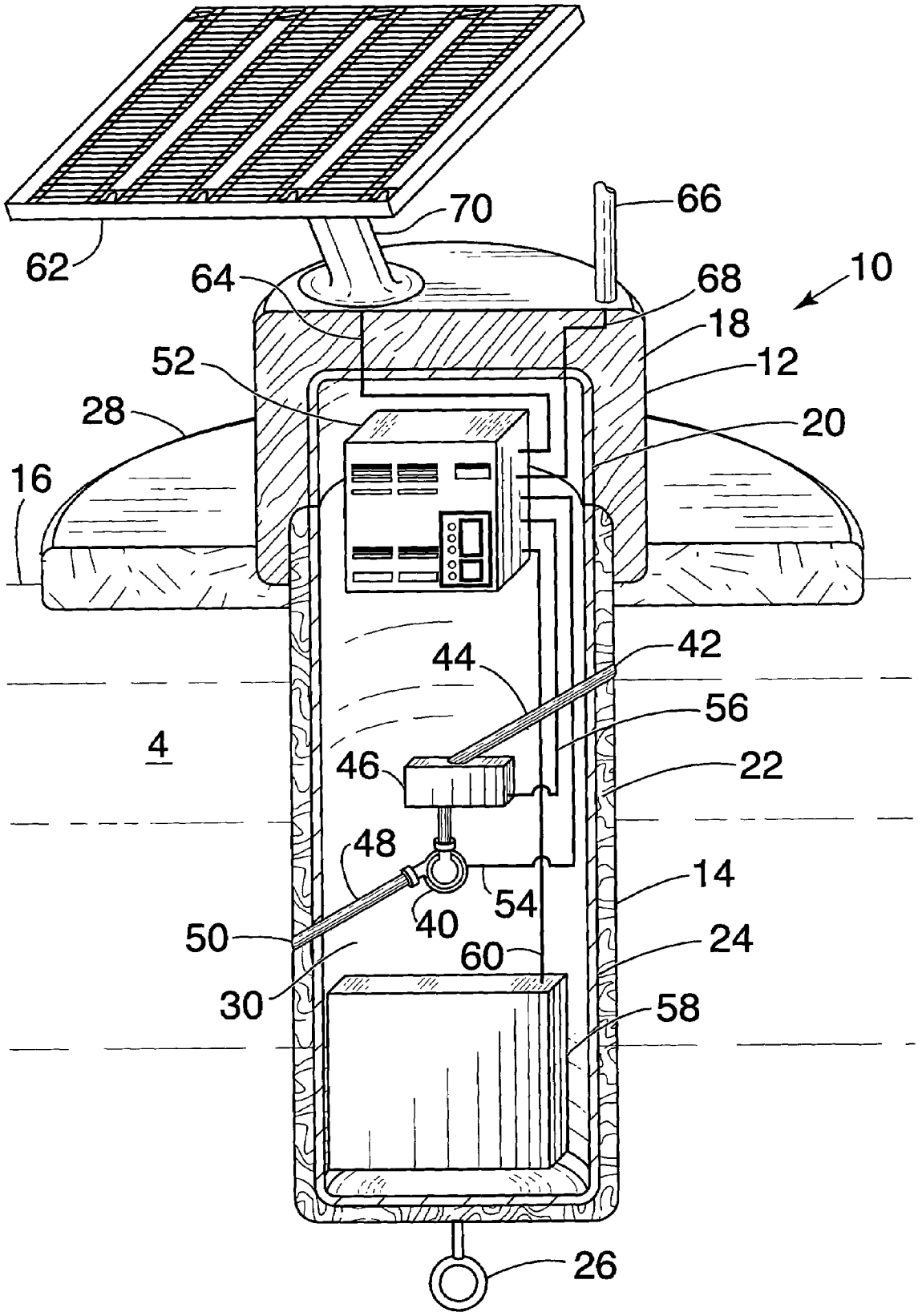
FIG. 2 is a cutaway view of an embodiment of the present invention that employs a thermally conductive lower section, and contains a system for detecting toxic agents in a water supply.

In another embodiment of the present invention, shown in FIG. 2, the present invention includes a remotely controlled, buoyant device for detecting toxic agents in water sources using chlorophyll fluorescence monitoring. This device, described in U.S. patent application Ser. No. 14/689,316, is designed to make rapid remote assessments of possible toxic contamination of source waters (reservoirs, rivers, lakes, etc.) prior to entry to drinking water distribution systems. It provides around-the-clock unattended monitoring and uses naturally occurring aquatic photosynthetic tissue as the sensing material. The present invention can be used as a first-alert warning system for terrorist attacks on, and/or accidental spills into municipal and military drinking water supplies. The present invention can operate continuously, periodically, or responsively to an externally generated signal.

Referring to FIG. 2, a tail-tube buoy 10 houses the water quality monitoring system in the interior 30 thereof. The buoy 10 comprises an upper section 12, which is disposed predominantly above the water line 16, and a lower section 14, which is disposed predominantly below the waterline 16. An anchoring ring 26 is usually attached to the bottom of the buoy 10. A buoyant stabilizing wing or collar 28 is usually attached at the waterline 16.

The upper section 12 is comprised of a thermally insulating material 18 and, optionally, an inner liner 20 to provide structural integrity. The thermally insulating material 18 protects the interior 30 from overheating in warm seasons, and from freezing in cold seasons. A conventional coating, layer, panel, or other type of shield may also be used therewith to shield the upper section 12 from direct sunlight, precipitation, and/or other environmental hazards.

The lower section 14 is preferably comprised of a thermally conductive material 22 and, optionally, an inner liner 24 to provide structural integrity and/or a waterproof seal. The thermally conductive material 22 protects the buoy 10 from becoming frozen during periods when a layer of ice forms on the surface 16 of the water 4. Sensible heat from deeper, warmer water is transferred upward to protect the interior 30 and equipment housed therein from freezing. Moreover, a layer of unfrozen water will remain around the buoy 10. Thus, the water monitoring system can continue to operate.

The selection of thermally conductive material 22 is based upon the specific climate of the location where the buoy is to be deployed. In temperate climates where ice formation is generally limited to no more than a few inches, the thermally conductive material 22 can be comprised of metal, for example, aluminum and/or copper. In such cases, an inner liner 24 is not generally necessary because the metal provides structural integrity and a waterproof seal.

Deployment of the buoy in progressively colder climates requires progressively greater capacity for transferring heat. This can be accomplished using, for example, a very high thermal conductivity graphite fiber composite material or graphite foam material as the thermally conductive material 22. Moreover, the thermally conductive material 22 can be extended below the bottom of the buoy, or the buoy itself can be elongated in order to reach deeper, warmer water. Moreover, the thermally conductive material 22 may be enhanced by increasing the surface area thereof by any means, such as, for example, flutes, fins, perforations, folds, etc.

FIG. 2 further shows a pump 40, which causes water to flow into the water quality monitoring system through an inlet 42, and influent tube 44, into a fluorometer 46, through an effluent tube, 48, and outlet 50. Location of the pump, inlet 42, outlet 50, and routing of the inlet and outlet tubes 44, 48 are not critical to the invention.

The fluorometer 46 is essentially as described in U.S. Pat. No. 6,569,384, referenced hereinabove. The inlet 42 may comprise a filter, screen, baffle, or other device to prevent solid materials from entering the influent tube 44. The pump 40 may be located anywhere along the inlet tube 44 or outlet tube 48. The pump 40 and fluorometer 46 are controlled by an electronics package 52 housed in the interior 30 and have respective electrical connections 54, 56 thereto.

A power supply 58, such as a deep-cycle battery, is also housed in the interior 30, and has electrical connection 60. A solar panel 62 or other device for harnessing natural energy is optionally mounted on the buoy 10, optionally with a support bracket 70 or the like, and has an electrical connection 64 to the electronics package 52, as shown, or directly to the power supply 58. The solar panel 62 preferably charges the battery 58. The electronics package 52 preferably monitors the power level, controls recharging cycles, and detects low battery and failure conditions. An antenna 66 is mounted on the buoy 10 and has an electrical connection 68 to the electronics package 52.

The invention can be integrated into a common data highway comprising comprehensive sets of homeland security sensors to provide rapid incident management in case of a water contamination event at susceptible real-time water monitoring locations. By strategically locating and connecting water sensors on existing commercial and government infrastructures, critical information can be sent to a command center within minutes of an event.

The ultimate goal is real-time, reliable, and secure transmission and processing of data and information for the accurate prediction of the event location, identification of the threat, its directional path over time, and the number of people that could be affected. By receiving this information on a real-time basis, the command center can immediately dispatch water facility managers and first responders to the event area.

Provided with such detailed information from the common data highway, effectiveness of the first responders will be greatly enhanced. They will have fast, accurate, and precise information available relating to the type of toxic agent involved and immediately execute the appropriate treatment. Also, if necessary, areas in the projected path of the toxic agent release can be evacuated in advance. The enhanced water monitoring system can be integrated to assure an ultra-high level of reliability, survivability and security, especially where the common data highway is salable across state, local, and federal governments.

See, for example, commonly assigned U.S. patent application Ser. No. 10/370,913 filed on Feb. 21, 2003 entitled "System for Detection of Hazardous Events", the entire disclosure of which is incorporated herein by reference.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A freeze resistant buoy system comprising a tail-tube buoy having:

an upper thermally insulated section disposed predominantly above a waterline region, said buoy further comprising;

a lower thermosiphon section disposed predominantly below said waterline region and having a bottom, wherein said lower thermosiphon section is further comprised of an outer shell and inner shell having a hollow space with heat transfer fluid therebetween; and wherein said lower thermosiphon section is configured to transfer heat from the bottom to the waterline region.

2. A freeze resistant buoy system in accordance with claim 1 wherein said thermo-siphon comprises a porous heat-exchange material.

3. A freeze resistant buoy system in accordance with claim 2 wherein said porous heat-exchange material comprises graphite foam.

4. A freeze resistant buoy system in accordance with claim 1 further comprising stabilizing collar attached to the housing.

5. A freeze resistant buoy system in accordance with claim 4 wherein said stabilizing collar is located at least proximate to an interface between said lower section and said upper section.

6. A freeze resistant buoy system comprising a tail-tube buoy having:

an upper thermally insulated section disposed predominantly above a waterline region, said buoy further comprising;

a lower thermosiphon section disposed predominantly below said waterline region and having a bottom, wherein said lower thermosiphon section is further comprised of an outer shell and inner shell having a hollow space with heat transfer fluid therebetween;

wherein said lower thermosiphon section is configured to transfer heat from the bottom to the waterline region; and a system housed within the buoy system for collecting and analyzing samples.

7. A freeze resistant buoy system in accordance with claim 6 wherein said system further comprises at least one device selected from the group consisting of mechanical, chemical, biological, electrical, electronic, sonic, and optical devices.

8. A freeze resistant buoy system in accordance with claim 6 wherein said system further comprises: a detector for detecting at least one toxic agent in a water sample; and introducing means for introducing a water sample into said detector and discharging said water sample from said detector.

9. A device in accordance with claim 8 wherein said detector further comprises a fluorometer for measuring photosynthetic activity of naturally occurring, indigenous photosynthetic organisms drawn into said detector system.

10. A device in accordance with claim 8 wherein said detector further comprises an electronics package that analyzes raw data from said detector and emits a signal indicating the presence of at least one toxic agent in said water.

11. A device in accordance with claim 8 that can wherein said device is configured as a component of an integrated data highway to which signal from said detector can provide the location and time of the introduction of at least one toxic agent in said water.

* * * * *